US012313361B2

(12) United States Patent
DeJessa

(10) Patent No.: US 12,313,361 B2
(45) Date of Patent: May 27, 2025

(54) MUZZLE MOUNT ASSEMBLY

(71) Applicant: Smith & Wesson Inc., Springfield, MA (US)

(72) Inventor: Joseph DeJessa, West Brookfield, MA (US)

(73) Assignee: Smith & Wesson Inc., Springfield, MA (US)

( * ) Notice: Subject to any disclaimer, the term of this patent is extended or adjusted under 35 U.S.C. 154(b) by 32 days.

(21) Appl. No.: 18/365,644

(22) Filed: Aug. 4, 2023

(65) Prior Publication Data

US 2024/0060742 A1 Feb. 22, 2024

Related U.S. Application Data

(60) Provisional application No. 63/371,677, filed on Aug. 17, 2022.

(51) Int. Cl.
*F41A 21/32* (2006.01)
*F41A 21/34* (2006.01)

(52) U.S. Cl.
CPC ..... *F41A 21/325* (2013.01); *F41A 21/34* (2013.01)

(58) Field of Classification Search
CPC ..... F41A 21/32; F41A 21/325; F41A 21/34; F41A 21/36; F41A 21/38
See application file for complete search history.

(56) References Cited

U.S. PATENT DOCUMENTS

| | | | | |
|---|---|---|---|---|
| 6,948,415 | B2 | 9/2005 | Matthews et al. | |
| 7,603,998 | B2 | 10/2009 | Finstad | |
| 7,676,976 | B2 | 3/2010 | Dueck et al. | |
| 7,789,009 | B1 | 9/2010 | Brittingham | |
| 7,946,069 | B2 | 5/2011 | Dueck et al. | |
| 8,091,462 | B2 | 1/2012 | Dueck et al. | |
| 8,186,261 | B2 | 5/2012 | McNeill et al. | |
| 8,209,895 | B2 | 7/2012 | Dueck et al. | |
| 8,210,087 | B2 | 7/2012 | Latka | |
| 8,291,805 | B1 | 10/2012 | Quilligan | |
| 8,459,406 | B1 | 6/2013 | Dueck | |
| 8,505,680 | B2 | 8/2013 | Dueck | |
| 8,714,301 | B2 | 5/2014 | Shults | |
| 8,794,376 | B2 | 8/2014 | Shults et al. | |
| 8,997,621 | B1 | 4/2015 | Dater et al. | |
| 9,328,984 | B2 | 5/2016 | Shults et al. | |
| 9,513,078 | B1 | 12/2016 | Fulton et al. | |
| 9,739,560 | B1 * | 8/2017 | Salvador | F41A 21/34 |

(Continued)

*Primary Examiner* — Jonathan C Weber
(74) *Attorney, Agent, or Firm* — Stinson LLP

(57) ABSTRACT

A mount assembly for attaching a firearm accessory to a muzzle of a firearm that promotes a more secure connection. The mounting assembly includes a front collar and a rear collar that are operable to clamp the mount assembly onto the muzzle. A detent ring mounted on the front collar yieldably biased by a spring against the rear collar to resist relative rotation of the front and rear collars. The mounting assembly is constructed so that the spring force applied by the spring does not continually increase as the front and rear collars move to clamp onto the muzzle. Detent springs used to yieldably hold the front and rear collars against relative rotation can be weaker than the main spring, which further reduces unwanted forces working against clamping of the mount assembly onto the muzzle. The mount assembly is also constructed to inhibit carbon lock.

20 Claims, 16 Drawing Sheets

(56) References Cited

U.S. PATENT DOCUMENTS

| | | | |
|---|---|---|---|
| 9,921,021 | B1 | 3/2018 | Graham, II |
| 9,958,227 | B2 | 5/2018 | Whitson |
| 10,082,355 | B2 | 9/2018 | Addis |
| 10,156,411 | B2 | 12/2018 | Thompson et al. |
| 10,184,744 | B2 | 1/2019 | Young et al. |
| 10,274,278 | B2 | 4/2019 | Dueck et al. |
| 10,480,884 | B2 | 11/2019 | Smith |
| 10,641,573 | B2 | 5/2020 | Jen et al. |
| 10,767,952 | B1 | 9/2020 | Till et al. |
| 10,801,796 | B2 | 10/2020 | Kras |
| 11,143,477 | B1 | 10/2021 | Oglesby |
| 2014/0237881 | A1 | 8/2014 | Mack |
| 2021/0199401 | A1 | 7/2021 | Magee et al. |
| 2021/0333062 | A1 | 10/2021 | Kada et al. |

* cited by examiner

MUZZLE MOUNT ASSEMBLY

FIELD

The present disclosure generally relates to amount assembly for connection of firearm accessories to a firearm muzzle.

BACKGROUND

Currently, firearm muzzle mounted firearm accessories, such as suppressors or any other accessory that attaches to the muzzle of the firearm, have various options of attachment. Traditional "thread mount" accessories or devices mount directly to the firearm via the firearm barrel's threaded muzzle. Thread mounted devices have a tendency to become loose over time and require the firearm to have a bare muzzle when the device is not attached. Conventional "quick mounts" allow for a relatively quicker attachment method by having some intermediary attachment or mount between the device and a proprietary adapter that is itself threaded to the muzzle. Over the years there have been various quick mount solutions developed in industry. However, both conventional "thread mount" and "quick mount" solutions have one or more deficiencies, such as (1) being complicated and therefore increasing the possibility for the user to attach incorrectly; (2) not actually providing a secure lockup or connection such that the system can become loose over time; (3) having significant mass that is then added to the end of the firearm; and/or (4) frequently becoming carbon locked (carbon locking occurs when burnt and unburnt powder gasses travel into and build up within the system, thereby preventing the user from removing the attachment).

SUMMARY

In one aspect, a mount assembly for attaching a firearm accessory to a muzzle of a firearm generally comprises a rear collar configured to connect to the muzzle. A front collar is coupled to the rear collar for movement relative to the rear collar. The front and rear collar are constructed and arranged relative to each other to capture a portion of the muzzle between them to attach the mount assembly to the muzzle. A detent ring is movable relative to the rear collar, and a spring is disposed between the detent ring and the front collar and generates a spring force biasing the detent ring toward the rear collar. The rear collar, the front collar, and the detent ring are shaped so that an amount of the spring force biasing the detent ring toward the rear collar decreases during at least a portion of a time the distance between the front collar and the rear collar decreases while attaching the mount assembly to the muzzle.

In another aspect, mount assembly for attaching a firearm accessory to a muzzle of a firearm generally comprises a rear collar configured to connect to the muzzle. A front collar is coupled to the rear collar for movement relative to the rear collar. The front and rear collar are constructed and arranged relative to each other to capture a portion of the muzzle between them to attach the mount assembly to the muzzle. A detent ring is movable relative to the rear collar, and a main spring is disposed between the detent ring and the front collar and generates a spring force biasing the detent ring toward the rear collar. A detent assembly comprises a detent supported by one of the rear collar and the detent ring, and a detent spring engaging the detent and biasing the detent against the detent ring. The main spring has a spring force greater than a spring force of the detent spring.

Other objects and features of the present disclosure will be in part apparent and in part pointed out herein.

BRIEF DESCRIPTION OF THE DRAWINGS

Corresponding reference characters indicate corresponding parts throughout the several views of the drawings.

DETAILED DESCRIPTION

Figure 1:
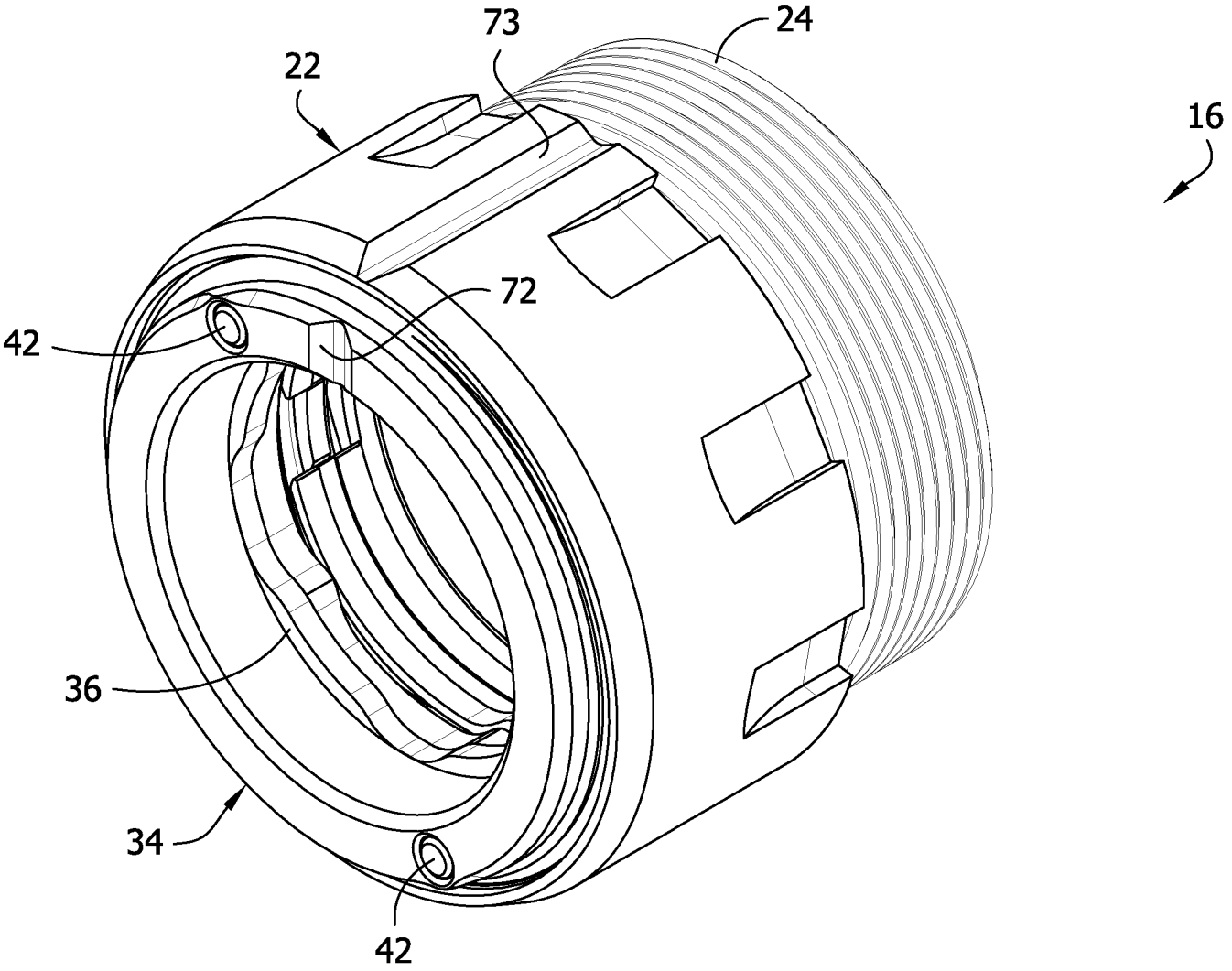
FIG. 1 is a perspective of a muzzle mount assembly of the present disclosure.
Figure 2:
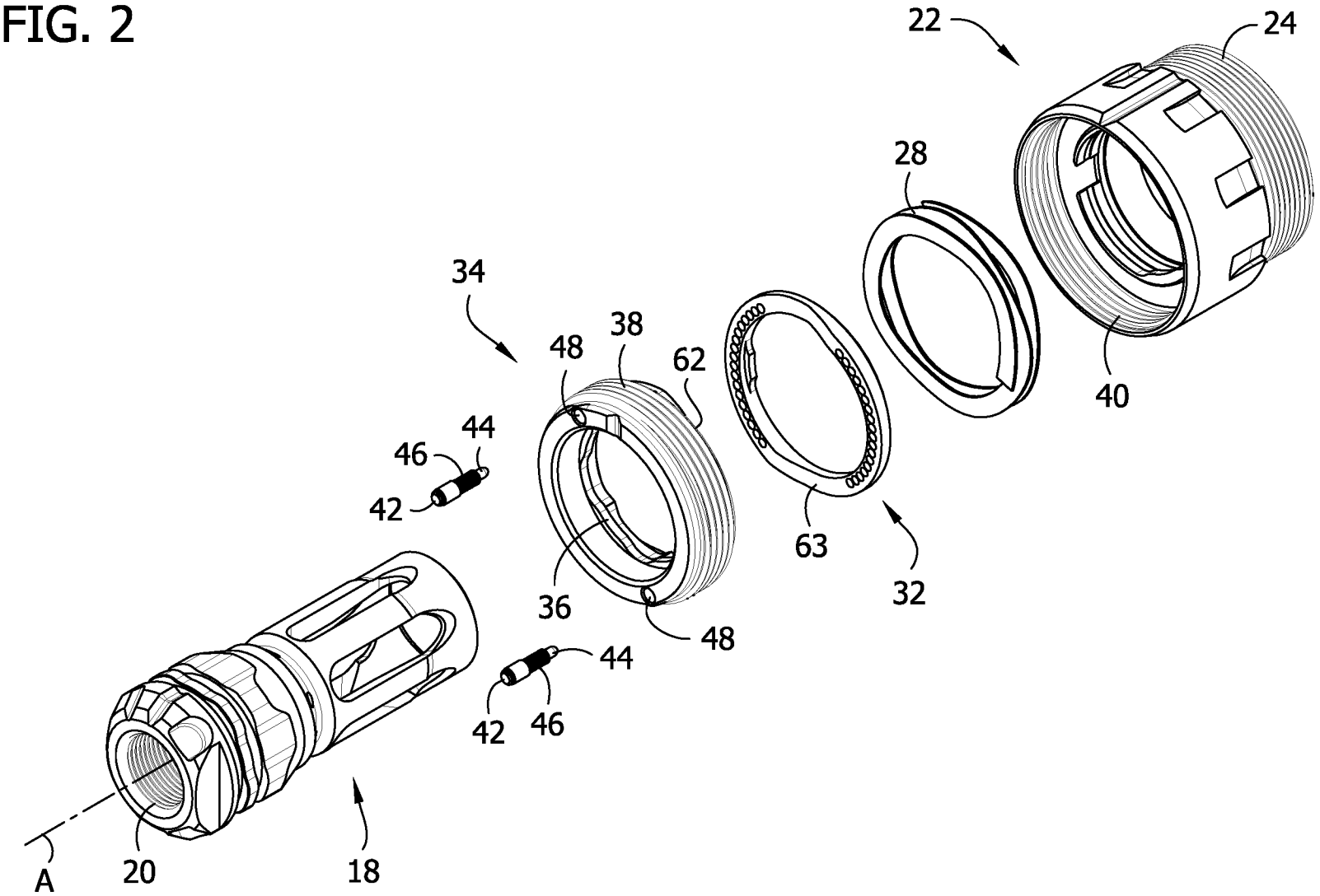
FIG. 2 is an exploded perspective of the muzzle mount shown with a flash hider.

Referring now to FIGS. 1 and 2 of the drawings, a muzzle mount assembly 16 ("mount assembly") constructed according to the principles of the present invention is configured to releasably mount on a muzzle of a firearm. In the illustrated embodiment, the muzzle of the firearm is formed by a flash hider 18 attached to the end of a firearm barrel (not shown). In the illustrated embodiment, the flash hider 18 has internal threads 20 that can be threaded onto external threads on the end of the firearm barrel. Other ways of attaching the flash hider 18 to the firearm barrel may be used. Moreover, other ways of attaching the muzzle mount assembly to the muzzle of a firearm may be used without departing from the scope of the present invention. For example and without limitation, the firearm barrel at the muzzle end may be formed with features similar to those of the flash hider 18 so that connection of the mount assembly 16 to the firearm muzzle can be accomplished without a flash hider. For purposes of the present description, the flash hider 18, or any other intermediate structure attached to the muzzle, is considered to be part of the muzzle.

Figure 4:
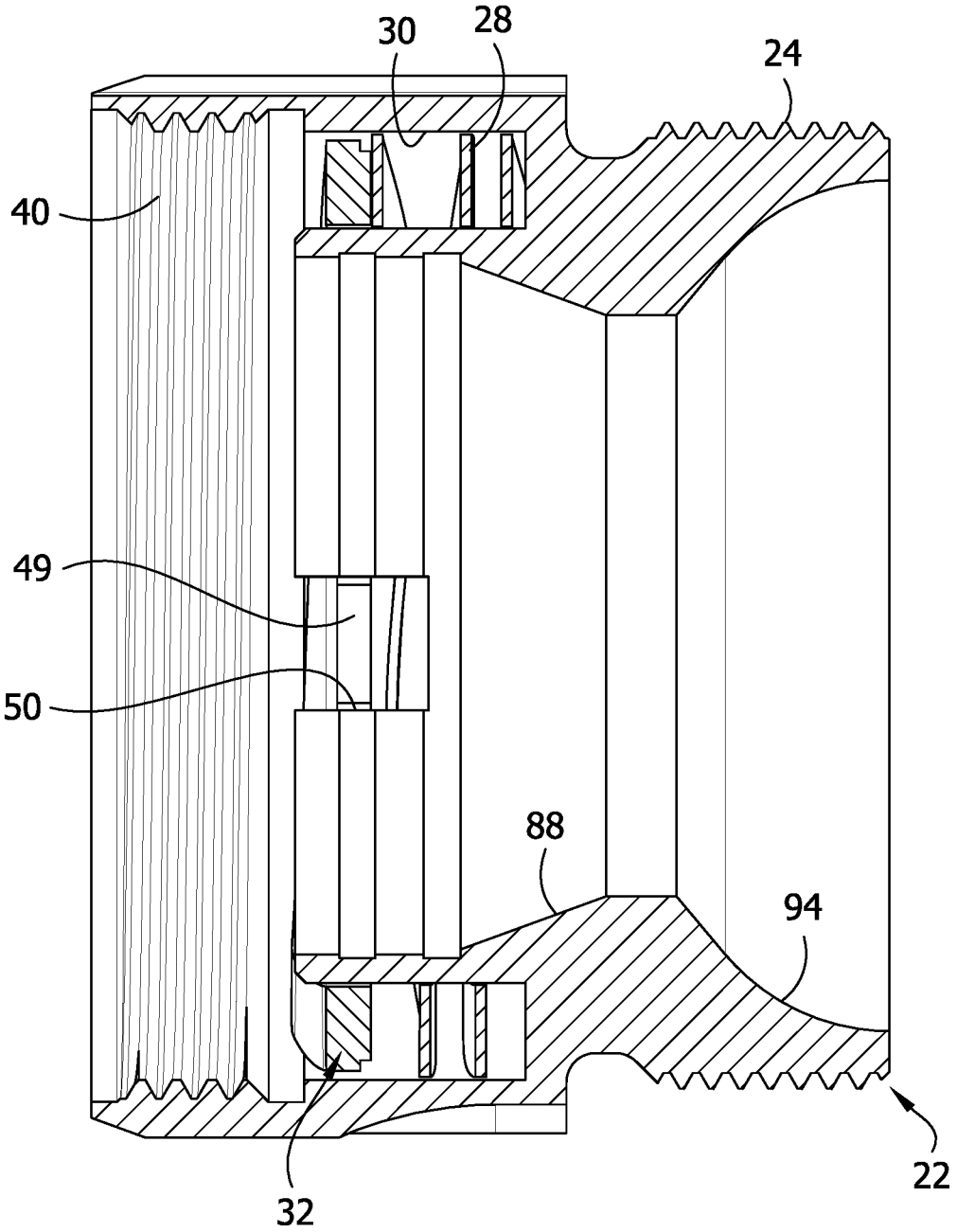
FIG. 4 is a longitudinal section of the muzzle mount assembly.

The mount assembly 16 is formed by a front collar 22 that has external threads 24 on a forward end of the front collar that can be used to mount a firearm accessory such as a suppressor (not shown). Other constructions for attaching the firearm accessory to the mount assembly may be used. The mount assembly 16 further includes components constructed for connecting to the flash hider 18. A main spring 28 received in an annular compartment 30 (see, FIG. 4) formed in the front collar 22 biases a detent ring 32 that is also received in the annular compartment in a rearward direction. One end of the main spring 28 engages a rearward facing surface of the front collar 22 in the annular compartment 30, and an opposite end of the main spring engages a forwardly facing surface of the detent ring 32. A rear collar 34 is formed with internal lugs 36 for connection to the flash hider 18 and external threads 38 for connection with internal threads 40 of the front collar 22. The rear collar 34 retains a pair of detent assemblies, each include a cap pin 42, a detent 44 and a detent spring 46 biasing the detent away, in a forward direction from the cap pin. Each detent assembly is secure in a respective throughhole 48 in the rear collar 34 by connection of the cap pin 42 with the rear collar. However, the detent 44 is free to move with respect to the cap pin 42 and the rear collar 34. The function of the detent assemblies will be explained in more detail hereinafter, but operate in general to yieldably resist relative rotation between the detent ring 32 (and hence the front collar 22) and the rear collar 34, which helps to prevent an undesirable loosening of the mount assembly 16 from the flash hider 18 as the firearm is used.

Figure 3:
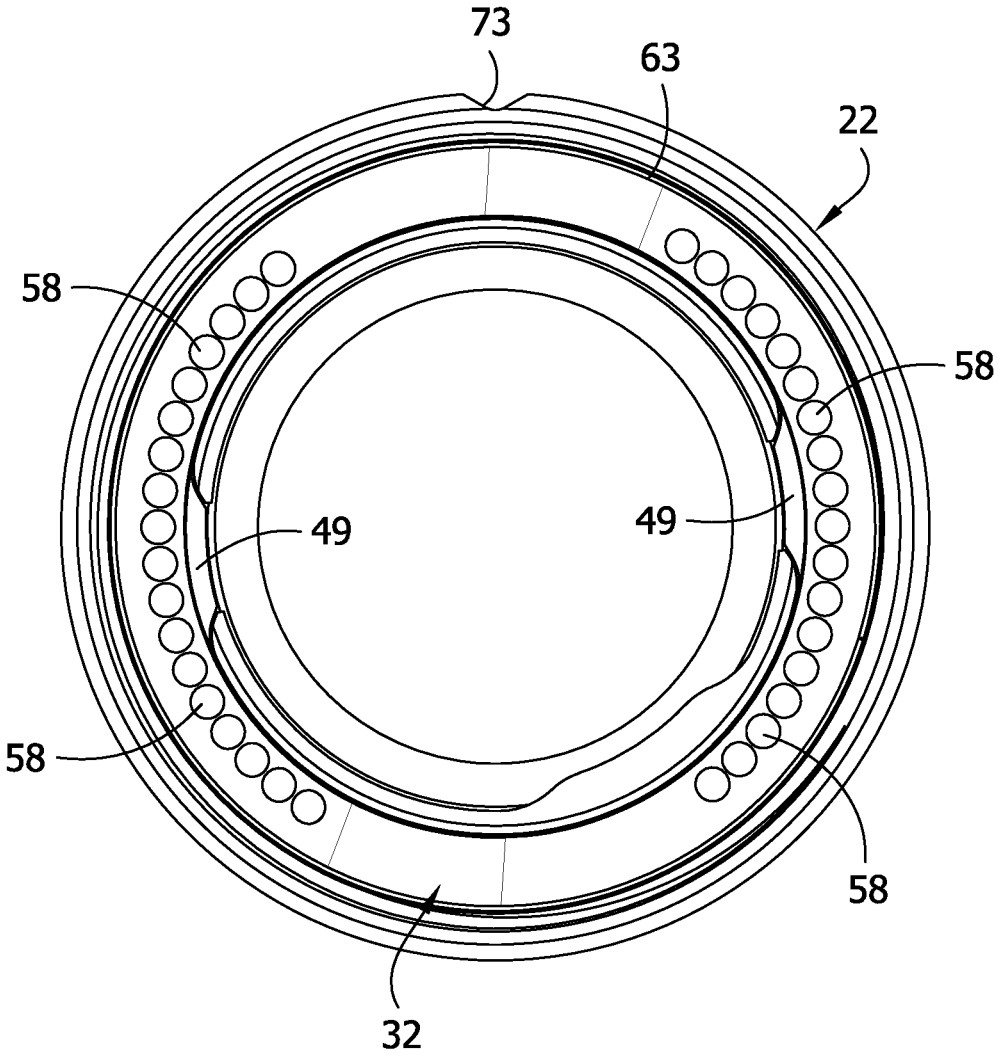
FIG. 3 is a rear end view of the muzzle mount assembly.
Figure 5:
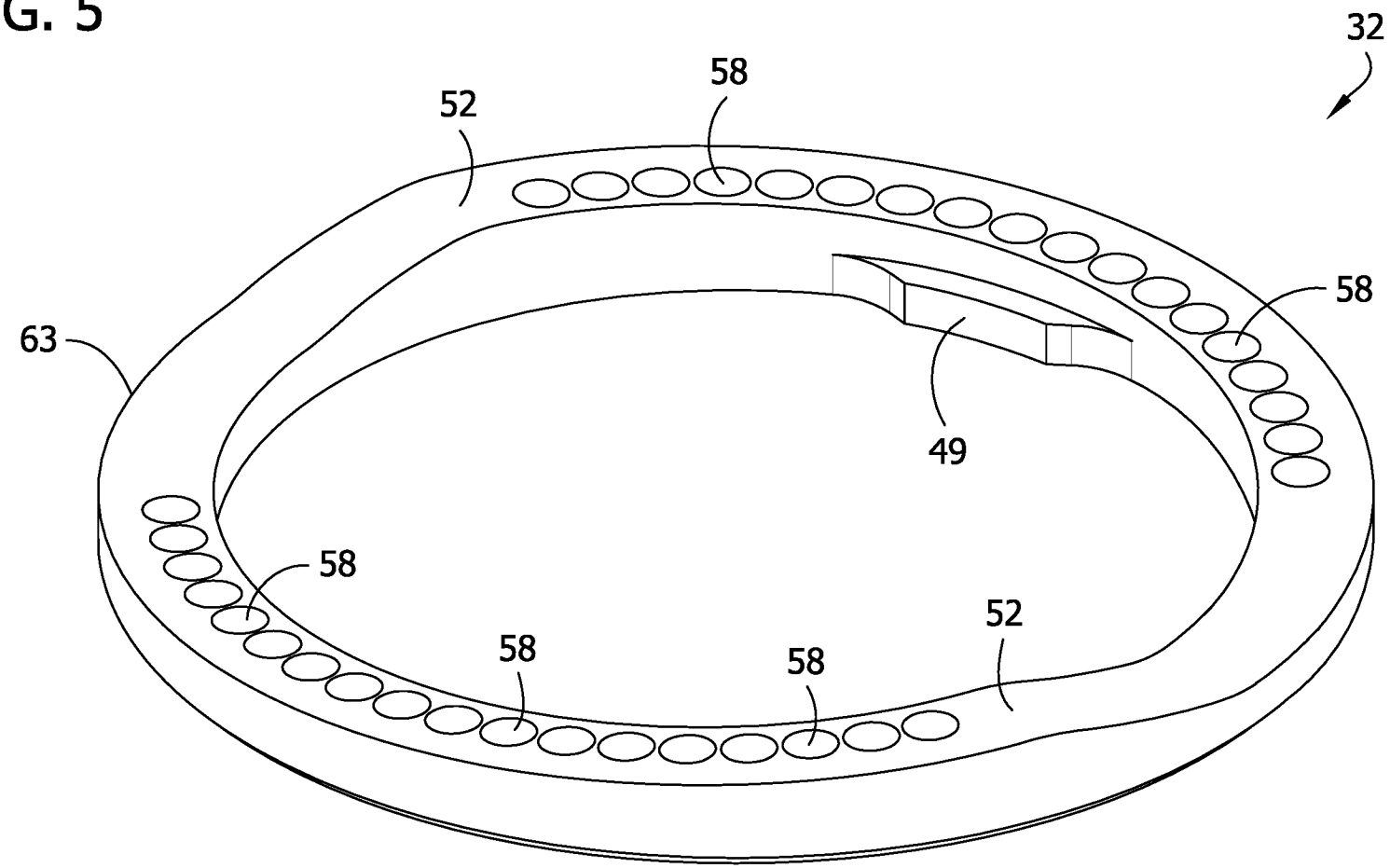
FIG. 5 is a perspective of a detent ring of the muzzle mount assembly from a first vantage.
Figure 6:
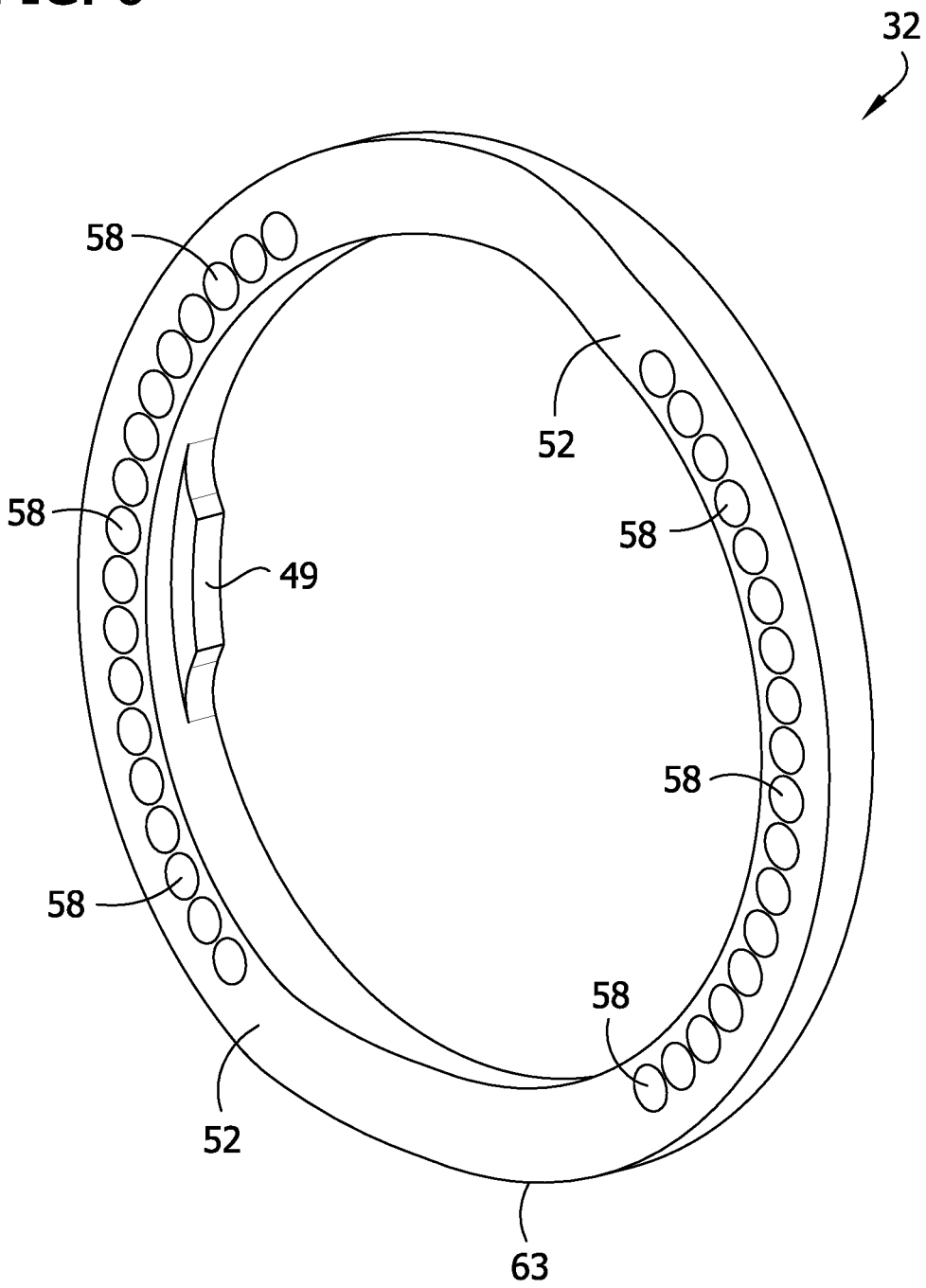
FIG. 6 is a perspective of a detent ring of the muzzle mount assembly from a second vantage.

The main spring 28, although retained in the annular compartment 30 has no other connection to the front collar 22 and is free to rotate in the annular compartment about an axis of rotation A generally corresponding to the barrel axis of the firearm when the mount assembly 16 is attached to the firearm. The detent ring 32 is fixed for conjoint rotation with the front collar 22, but free to move along the barrel axis A with respect to the front collar. More particularly as may be seen in FIGS. 3 and 4, the detent ring 32 is formed with a pair of keys 48 each of which is received in a respective slot 50 formed in an interior wall of the annular compartment 30. The detent ring 32 and rear collar 34 are constructed to achieve a variable resistance to relative rotation that reduces the impact of the main spring 28 on the securement of the mount assembly 16 to the flash hider 18. Referring to FIGS. 5 and 6, the rear face 63 of the detent ring 32 that interfaces with a forward face 62 of the rear collar 34 includes a pair of lobes 52. It will be understood that the number of lobes 52 could be greater or fewer than shown. The rear face 63 of the detent ring 32 has two circumferentially extending segments separated by the lobes 52, each beginning adjacent a respective one of the lobes and sloping downward gradually to a location near the opposite lobe. A short, steeper declining surface of the lobe 52 connects each of the two segments of the rear face 63 to the peak of the opposite lobe. The upward slope of each segment of the rear face 63 corresponds to an increase in thickness of the detent ring 32. Each segment that gradually slopes downward intersects the steeper sloped surface of the lobe 52 at a point of minimum thickness of the detent ring 32. In addition, the rear face segments of the detent ring 32 have circumferentially spaced recesses 58 that receive the detents 44 as will be described.

Figure 9:
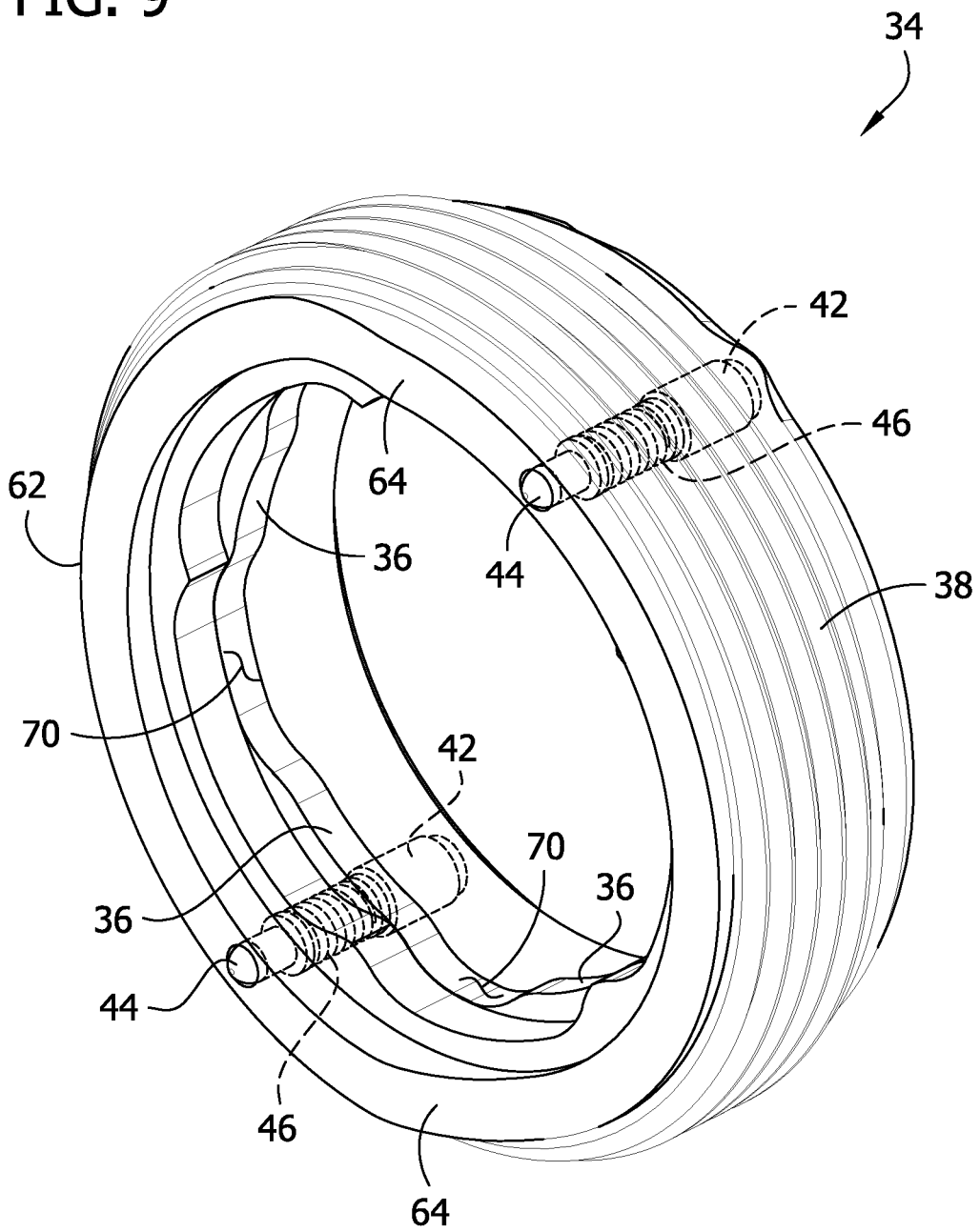
FIG. 9 is transparent perspective of the rear collar.

An annular forward face 62 of the rear collar 34 has a pair of lobes 64, and is complementary in shape to the rear face 63 of the detent ring 32 (see, FIG. 9). As the muzzle mount 16 is being attached to the flash hider 18, the forward face 62 of the rear collar 34 (a first cam interface) engages the rear face 63 of the detent ring 32 (a second cam interface) to provide a camming action between the detent ring 32 and rear collar 34. An effect of the shape of the forward face 62 of the rear collar 34 is to vary the longitudinal dimension of the rear collar about the circumference of the forward face. The shape of the forward face 62 and the rear face 63 of the detent ring 32 changes the amount of displacement the main spring 28 undergoes while the mount assembly 16 is being coupled to the flash hider 18, thereby varying the amount of retention force imparted on the rear collar by the detent ring, as will be described more fully hereinafter. In other words, the minimum force required of the user to attach the mount assembly 16 to the flash hider 18 goes up and down in the process of coupling of the mount assembly to the flash hider. The lobes 52 on the rear face 63 of the detent ring 32 and the lobes 64 on the forward face 62 of the rear collar 34 are arranged such that the amount of user input force required to secure the mount assembly 16 to the flash hider 18 reduces the more the mount assembly is rotated or tightened onto the flash hider. This is unlike what happens with conventional mount assemblies (not shown) used to attach a firearm accessory to a flash hider, in which the main spring is continuously compressed to an ever greater extent throughout the process of attaching the mount assembly to the flash hider. As a result, in conventional attachments the progressive greater compression of a main spring leads to progressively greater resistance to tightening of the mount assembly onto the flash hider or muzzle, which results in the mount assembly not being tightened as much onto the flash hider.

Figure 7C:
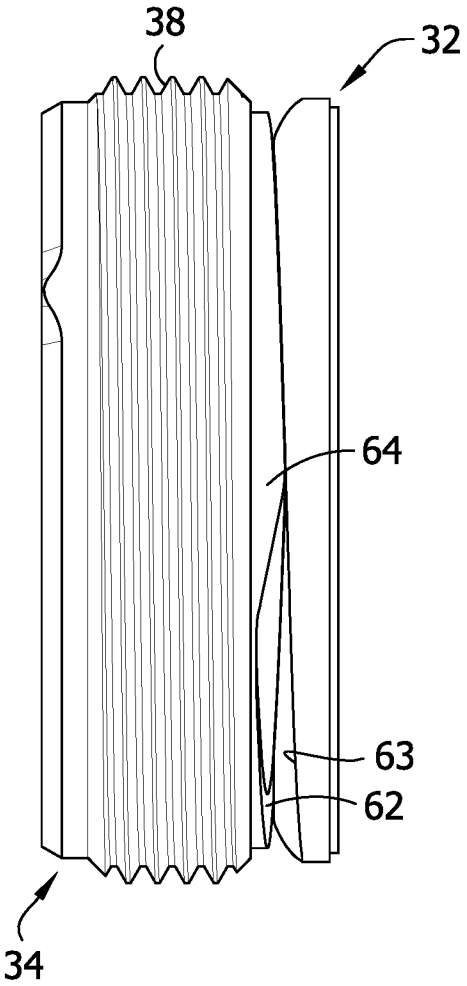
FIGS. 7A-7C are side elevations of the detent ring and a rear collar of the muzzle assembly illustrating their interaction during attachment of the muzzle mounting assembly to a muzzle of a firearm.
Figure 7B:
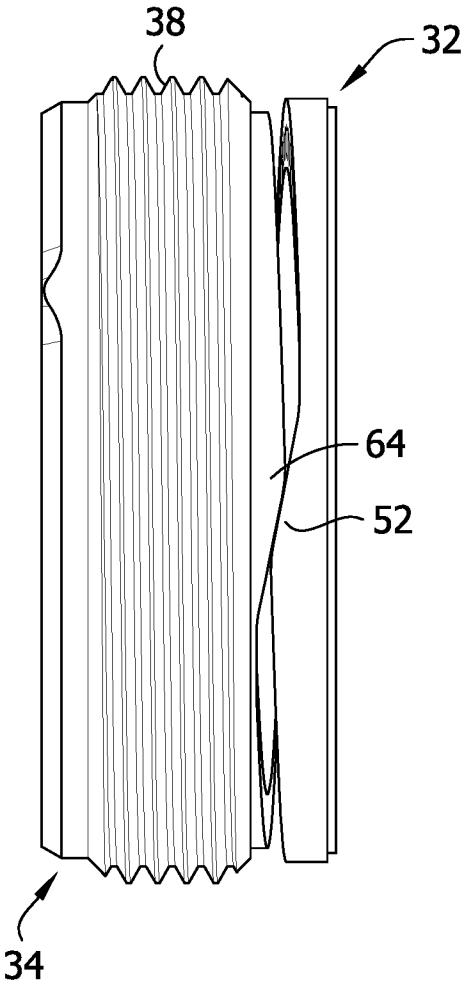
Figure 7A:
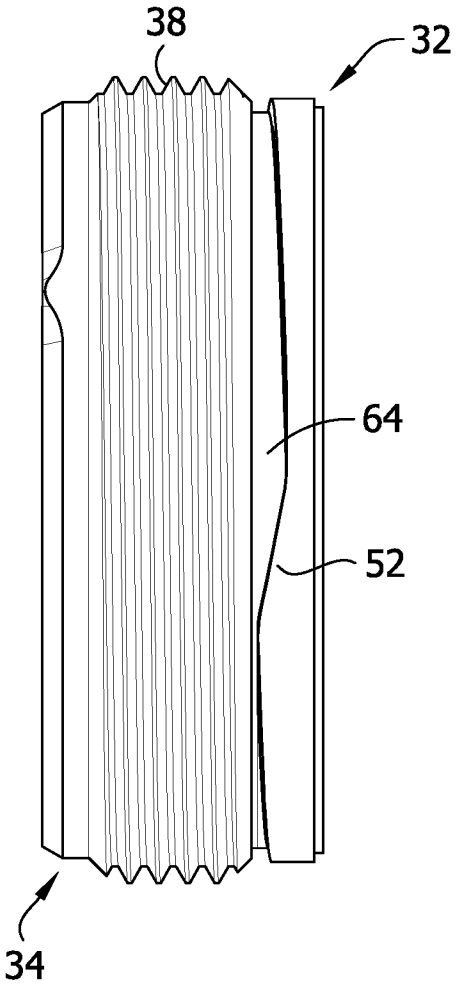

Referring to FIGS. 7A-C, the rear collar 34 has a surface profile of the forward or second interface face 62 that is generally a mirror image of the rear or first interface face of the detent ring 32. Thus, the lobes 64 of the second cam interface 62 are a mirror image of the lobes 52 first cam interface. As shown schematically in FIGS. 7A-C below, the first and second interface faces engage each other. In operation, the detent ring 32 and the rear collar 34 are in initially in the positions shown in FIG. 7A. The steeper sloped surfaces of each of the lobes 52 and 64 engage each other. In this starting position, the lobes 64, 52 on both the rear collar 34 and detent ring 32 sit such that attempting to rotate the mount assembly in either direction would cause a displacement of the main spring 28. As the mount assembly 16 is rotated, the detent ring 32 rotates conjointly with mount assembly because of engagement of the keys 49 of the detent ring in the slots 50 of the front collar 22.

As the mount assembly 16 and detent ring 32 rotate, the lobe 52 of the detent ring moves upward relative to the rear collar 34 from its position in FIG. 7A to its position in FIG. 7B. In making this movement, the more steeply sloped surface of the lobe 52 of the detent spring rides up the steeper sloped surface of the lobe 64 of the rear collar 34. It will be understood that the same interaction occurs at the same time between the corresponding lobes 52, 64 on the opposite side that cannot be seen in FIGS. 7A-7C. The camming interface of the lobes 52, 64 forces the detent ring 32 to move (in the orientation of FIGS. 7A-7C the detent ring moves to the right). This causes displacement or compression of the main spring 28, which increases the spring force urging the detent ring 32 back to the left. Thus the friction between the detent ring 32 and the rear collar 34, and therefore the user input force required to rotate the assembly increases relatively quickly. Continuing to rotate the mount assembly 16 toward the position shown in FIG. 7C causes the lobe 52 of the detent ring 32 to crest the lobe 64 on the rear collar 34, and the more gently sloped surfaces of the detent ring and rear collar engage each other. The axial extent of the rear collar 34 and the thickness of the portion of the detent spring 32 engaging the forward face 62 of the rear collar decrease in this region. Therefore, as the detent ring 32 moves from the position of FIG. 7B to that of FIG. 7C, the main spring force begins to reduce as deflection main spring 28 is reduced. This reduction in deflection, or lengthening, of the main spring 28 occurs even as the front collar 22 continues to be drawn toward (or over) the rear collar 34 by rotation and engagement of the threads 40, 38. At the position shown in FIG. 7C, the spring force of the main spring 28 is reduced back to the original load, however now the mount assembly 16 has been installed on the flash hider 18. This allows for less stress in the main spring 28 when the firearm is being shot, as the main spring is compressed maximally only during installation and removal, not during the high heat environment of use. It also means that the friction force between the detent ring 32 and rear collar 34 reduces the more the mount assembly 16 is tightened onto the flash hider 18. This reduction in friction losses equates to more of the user's input torque being applied to the clamping force used to secure the mount assembly to the flash hider, described in more detail below.

Figure 8:
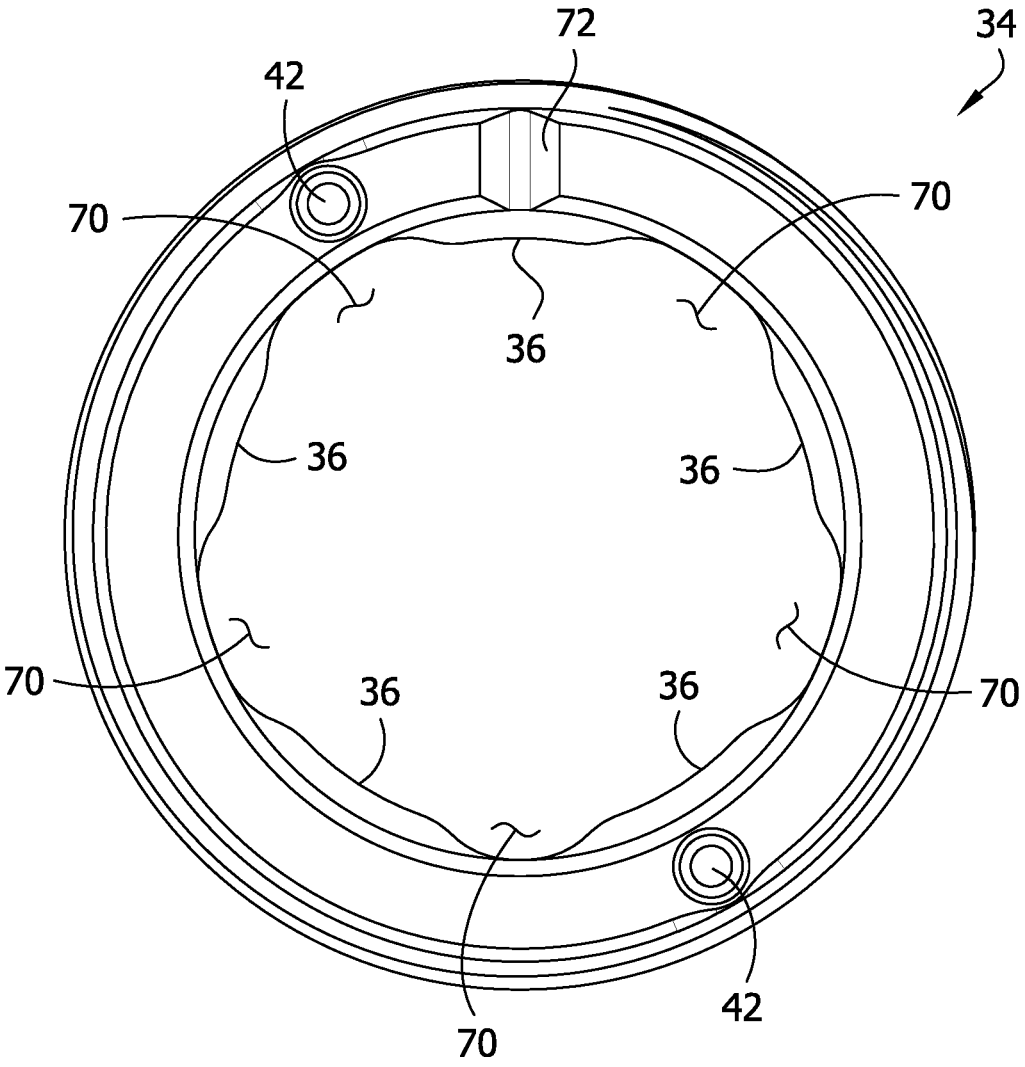
FIG. 8 is a rear elevation of the rear collar.

Referring to FIG. 8, the rear collar 34 has attachment structure, such as flash hider attachment structure, configured to attach to or interface with the flash hider 18. The attachment structure can engage and couple with to the flash hider 18 by inserting the rear collar 34 onto the flash hider and then turning the rear collar about the axis of rotation A relative to the flash hider. In the illustrated embodiment, the attachment structure includes the lugs 36 separated by gaps 70, forming a lug pattern. The lug pattern facilitates alignment with the flash hider 18 and includes one lug of a different size and/or shape than the others, thereby limiting the rear collar 34 to only one installation position. To identify this one installation position, the rear collar 34 includes an alignment notch 72 and the front collar 22 includes an alignment notch 73, which can be visually aligned with a corresponding alignment notch 74 on the flash hider 18 to arrange the rear collar 34 and mount assembly 16 relative to the flash hider for coupling in the one installation position (see, FIG. 11). The alignment notches 72, 74 can be broadly considered to be "alignment indicators." Attachment structure is well known in the art and thus a further detailed description is omitted herein. It is understood the other alignment structures are within the scope of the present disclosure.

The rear collar 34 houses and supports the detent assemblies, including the cap pin 42, detent 44, detent spring 46. The detent 44 is operatively connected to the cap pin 42 for lengthwise movement with respect to the cap pin. The detent spring 46 biases the detent 44 away from the cap pin 42 and outwardly from the front face of the detent ring 32. The detent assemblies are generally hidden from view in several of the figures herein but are shown below in FIGS. 2 and 9. The detents 44 project from the forward face 62 of the rear collar 34 to engage the detent ring 32. The detent ring 32 has suitable detent features, such as the recesses 58 which receive and interact with the detents 44 to create both audible clicks and a small additional retention force between the rear collar 34 and the detent ring yieldably inhibiting relative rotation. The audible clicks, which are caused by the detents 44 snapping into and/or out of the recesses 58, inform the user that additional securing or tightening of the mount assembly 16 to the flash hider 18 is occurring, even though the user experiences the sensation of less user input force being required to continue securing or tightening the mount assembly to the flash hider, as described previously herein.

Figure 10:
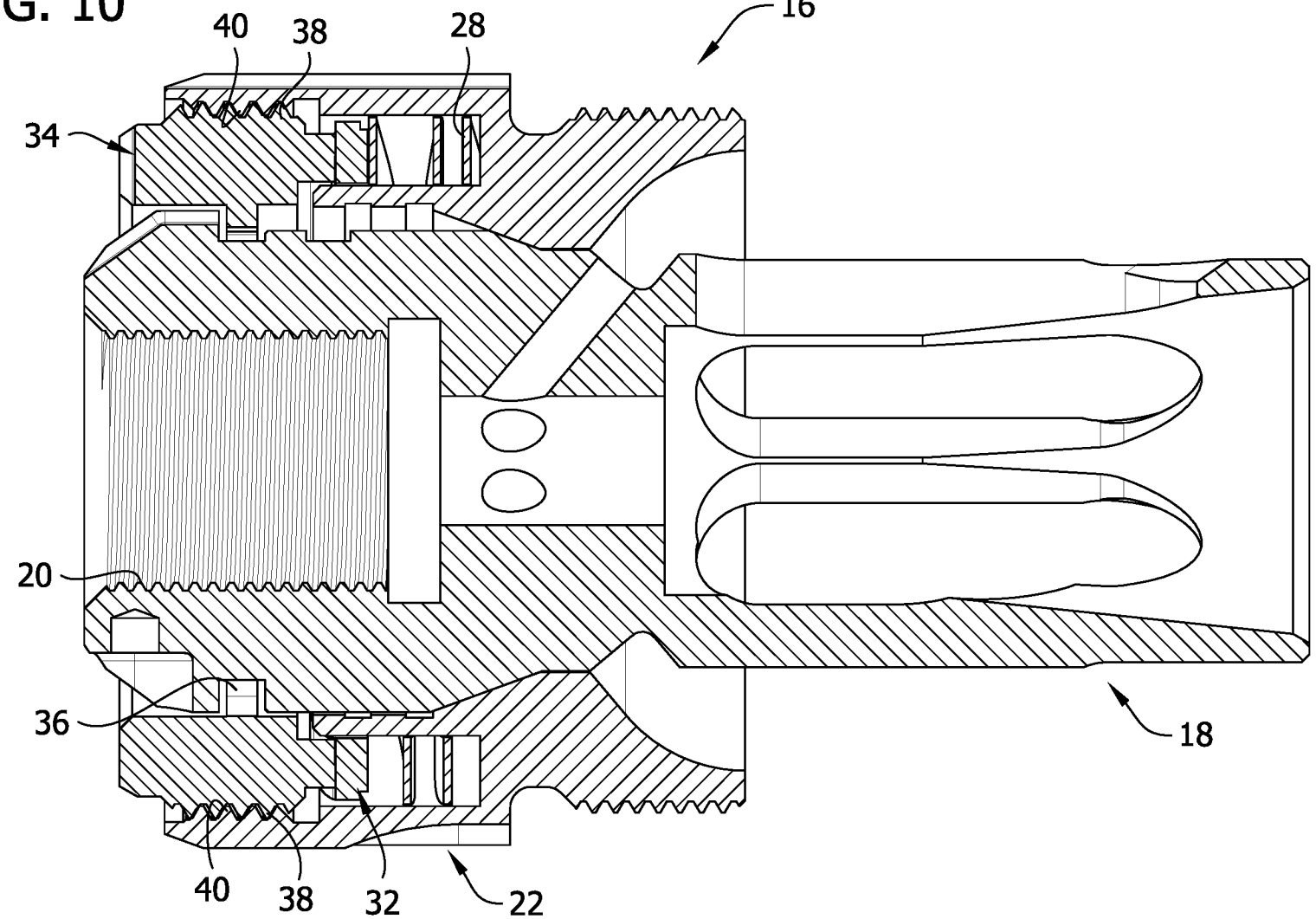
FIG. 10 is a longitudinal section of the muzzle mounting assembly as received on a flash hider of the muzzle.

As shown in FIG. 10, the rear collar 34 and the front collar 22 are rotatably coupled together by a threaded interface. The threaded interface permits the front collar 22 and rear collar 34 to rotate relative to one another. More specifically, the rear collar 34 becomes rotationally locked with the flash hider 18 so that rotation of the front collar 22 draws the front collar toward the rear collar. Thus, the threaded interface permits longitudinal movement along the axis of rotation A of the rear collar 34 and front collar 22 relative to one another to clamp the mount assembly 16 onto the flash hider 18 and to release the mount assembly from the flash hider. In order to connect the mount assembly 16 to the flash hider 18, the rear collar 34 moves toward the front collar 22 to clamp a portion of the flash hider 18 between them to secure the mount assembly 16 to the flash hider.

Figure 11:
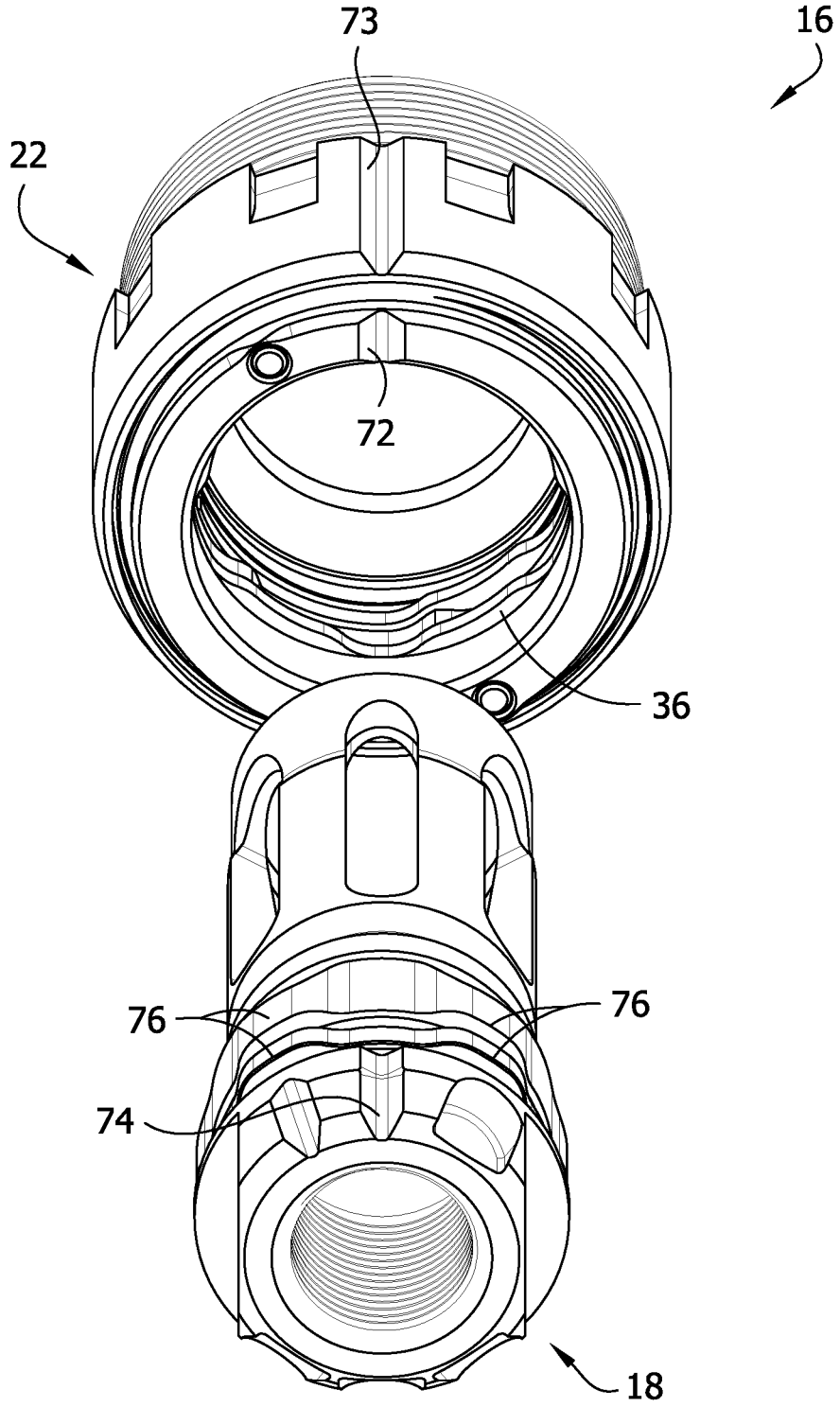
FIG. 11 is a perspective of the muzzle mount assembly aligned with but separated from the flash hider.
Figure 12:
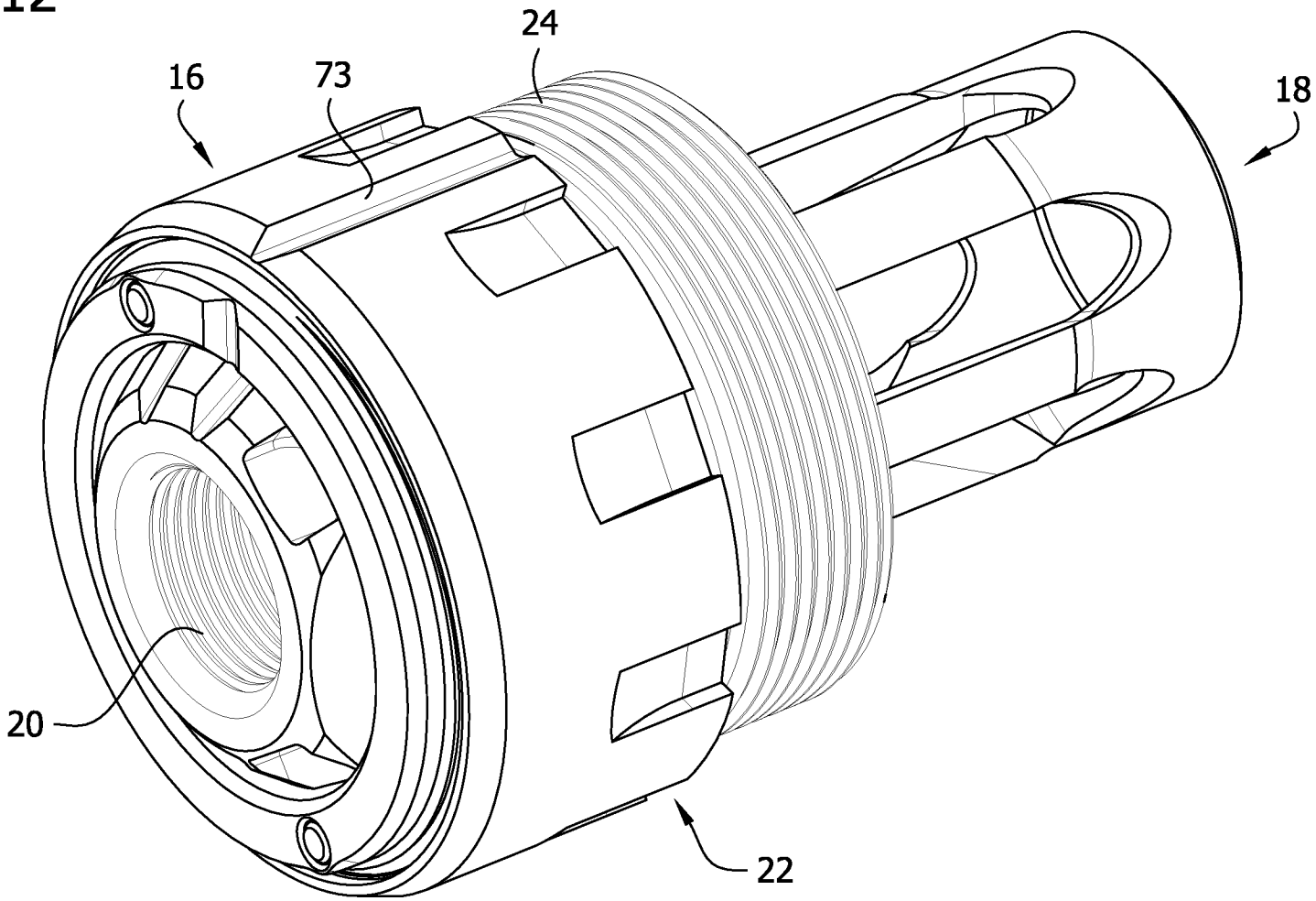
FIG. 12 is a perspective of the muzzle mount assembly mounted on the flash hider.

With reference to FIGS. 7A-C above and FIGS. 11-13A-B, the sequence of operation for attaching the mount assembly 16 to the flash hider 18 will now be described. Using the alignment notch 72 of the rear collar 34 and the alignment notch 74 of flash hider 18, the user orients the mount assembly 16 relative to the flash hider, as shown in FIG. 11, and slides the mount assembly onto the flash hider, as shown in FIG. 12. A forward portion of the flash hider 18 passes entirely through the mount assembly 16. However, a rear portion of the flash hider 18 includes lugs 76 for engaging with the rear collar 34. The rear collar 34 has attachment structure (lugs 36 and gaps 70) that interfaces with the lugs 76 flash hider 18. The gaps 70 of the rear collar 34 and corresponding gaps between lugs 76 on the flash hider 18 allow the lugs 36 of the rear collar to pass the lugs 76 of the flash hider so that the mount assembly can slide onto the flash hider.

Figure 13A:
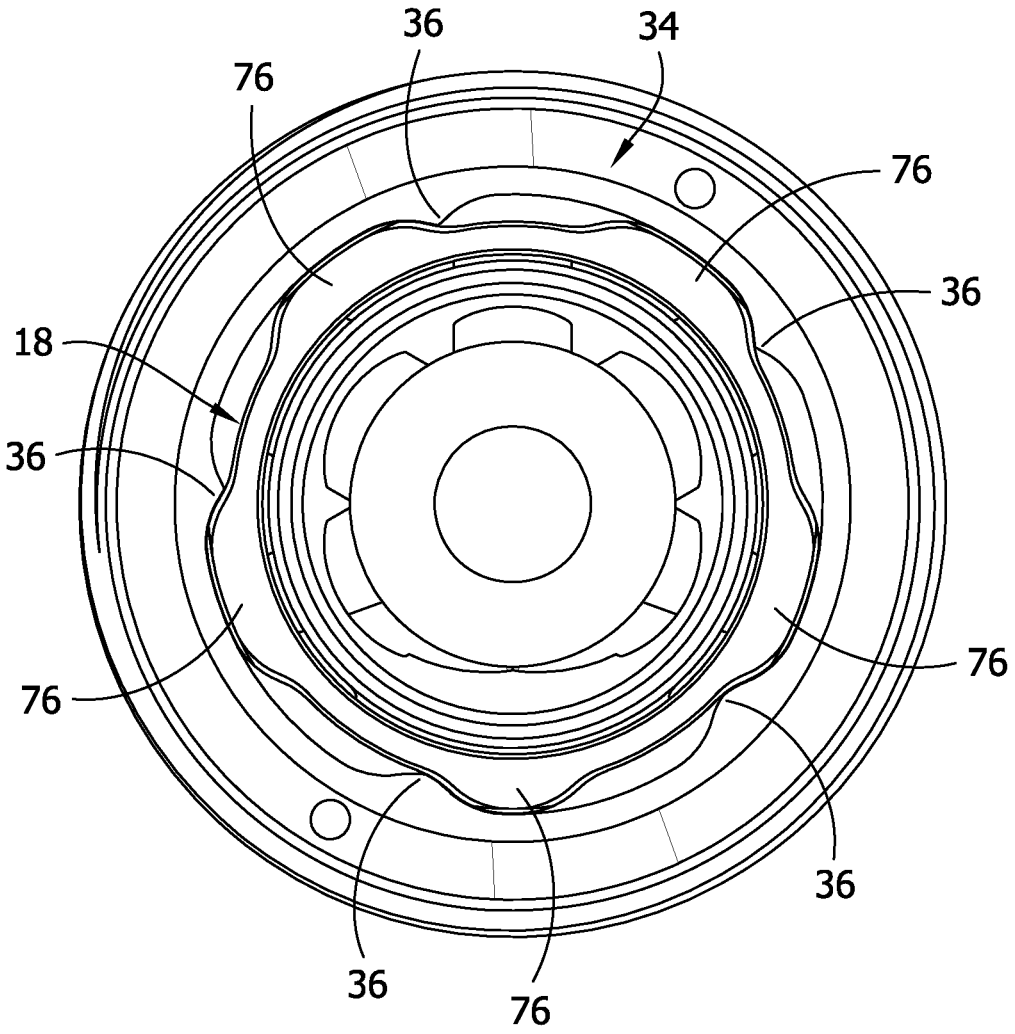
FIG. 13A is a schematic, rear end view of the muzzle mount assembly mounted on the flash hider with lugs of the muzzle mount assembly and the flash hider unengaged.
Figure 13B:
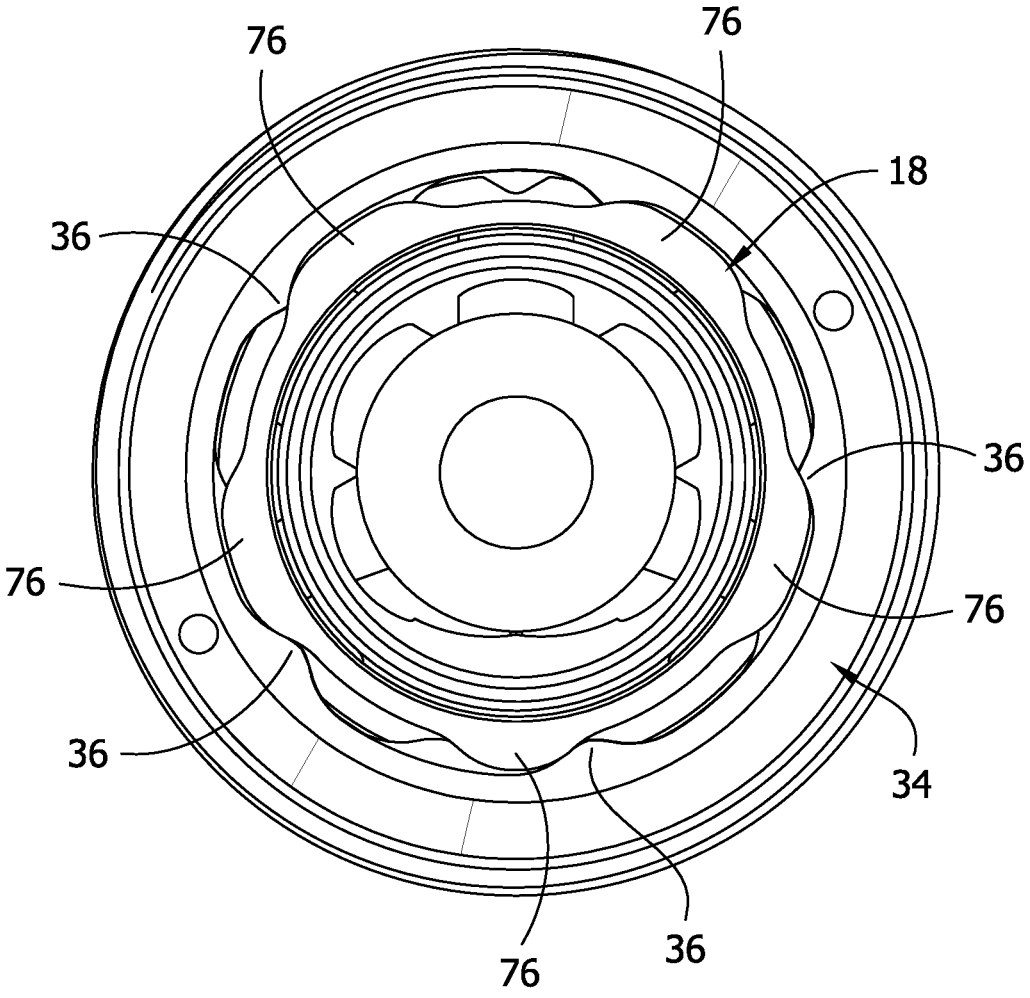
FIG. 13B is a schematic, rear end view of the muzzle mount assembly mounted on the flash hider with the lugs of the muzzle mount assembly and the flash hider engaged.

After the rear collar 34 is slid onto the flash hider 18, as shown in FIG. 13A, the mount assembly 16 is rotated clockwise about the axis of rotation A relative to the flash hider. Specifically, the user rotates the front collar 22 about the axis of rotation A. As this stage, the front collar 22 and the rear collar 34 rotate together due to the engagement of the rear collar with the detent ring 32. The force of the main spring 28 and the detent springs hold the detents 44 in the recesses 58 so that the detent ring 32 (which is rotationally fixed to the front collar 22) and the rear collar 34 rotate conjointly. In this embodiment, the rear collar 34 can freely rotate about 30 degrees relative to the flash hider 18 before the lugs 36 of the rear collar engage the corresponding structure of the flash hider, as generally shown in FIG. 13B. At this point, the rear collar 34 can no longer rotate relative to the flash hider 18, and therefore can no longer rotate conjointly with the detent ring 32 and front collar 22. The mount assembly 16 is not as yet secured to the flash hider 18. Further rotation of the front collar 22 and detent ring 32 causes the force of the detent springs 46 to be overcome so that the detents 44 move out of the recesses 58, allowing relative rotation between the rear collar 34 and the detent ring and front collar. As previously noted, this action produces an audible click. The threads 38 of the rear collar 34 are engaged with the threads 40 of the front collar 32 so that rotation of the front collar relative to the rear collar draws the front collar toward the rear collar along the axis of rotation A.

The front collar 22 and detent ring 32 rotate with respect to the rear collar 34 from the position shown in FIG. 7A to that shown in FIG. 7B. This creates an initial larger resistance force the user has to overcome in order to continue to rotate the front collar 22 of the mount assembly 16 to finish securing the mount assembly to the flash hider 18. As the user continues to rotate the front collar 22, the detent ring 32 moves from the position shown in FIG. 7B, to the position shown in FIG. 7C, which lessens the force applied by the main spring 28 against the rear collar 34 and thereby lessens the resistance force, as explained above, the user has to overcome to continue rotating the front collar relative to the rear collar. As the front collar 22 is further rotated to secure the mount assembly 16 to the flash hider 18, the resistance force the user experiences to rotation lessens, as explained above.

As the user continues to rotate the front collar 22 and detent ring 32 relative to the rear collar 34, the threaded interface between the front collar and the rear collar causes the front collar to be pulled toward the muzzle of the firearm. This continues until the mount assembly 16 applies a clamping force on the flash hider 18, thereby securing the mount assembly to the flash hider. Referring to FIG. 10, this clamping force is applied against the flash hider 18 by the rear collar 34 (e.g., the attachment structure thereof) and a tapered seat 88 of the front collar 22. Once clamped, the mount assembly 16 relies on the static friction generated between the three components (e.g., flash hider 18, rear collar 34, front collar 22) on each of the clamping surfaces to maintain the secure connection between the mount assembly and flash hider during use of the firearm. The static friction is a function of the clamping force and the finishes of the engaging surfaces. The clamping force generated by the thread interface (38, 40) of the front and rear collars 22, 34 must be maintained to ensure the mount assembly 16 does not loosen with use. To ensure this, the lobe/cam path on the rear collar/detent ring interface uses the force from the main spring 28 to keep the front collar 22 and rear collar 34 from rotating relative to one another. The cam path pitch is steeper than the thread interface pitch which means any rotation between the rear collar 34 and front collar 22 would need to overcome the force of the main spring 28 to rotate at all. In essence, the torque required to unthread the front collar 22 from the rear collar is higher than what the static friction of the clamping surfaces can withstand. So the front collar 22 will not unthread from the rear collar 34, without user input, thus maintaining the clamping load of the mount assembly 16 against the flash hider 18.

As is apparent from the above disclosure, the detent assemblies operate independently of the main spring 28. This provides several advantages. For instance, the main spring 28 has no effect on the detent force beyond a substantially constant baseline, unlike other conventional attachment detent structures. This allows the detent springs 46 of the detent assemblies to be significantly weaker than the main spring 28, which allows the detent ring 32 to easily overcome or collapse the detent springs. This also means the torque required to advance out of a recess 58 (e.g., to compress the detent springs 46) is generally constant and independent of the amount of rotation of the mount assembly 16 (e.g., the amount of rotation between the rear collar 34 and the front collar 22).

In addition, the detent assemblies (e.g., detent springs 46) do not impact the clamping force applied by the mount assembly 16 against the flash hider 18. Conventional attachment detent methods and the mount assembly 16 of the present disclosure have multiple potential avenues in which the user input imparted to couple the conventional device or mount assembly to the flash hider is reduced through friction. For example, friction in the threads 40, 38 of the front collar 22 and the rear collar 34 is a major loss. This is important because ultimately the amount of clamping force the mount assembly 16 imparts on the flash hider 18 is a direct result of the user input force/torque imparted by interaction of the threads 40, 38 as the front collar 22 and detent ring 32 turn relative to the rear collar 34. Accordingly, any force losses that occur in the conventional device or mount assembly 16 between the user input force and the clamping force, reduce the amount of clamping force applied to the flash hider, making an unintentional disconnection more likely. In conventional devices, where the detent action is impacted by the main spring, the detent action becomes another source of these force losses, because the detent springs must exert a sufficiently high force to be able to overcome the main spring. This results in a strong reaction force applied to the threads of the rear collar against the threads of the front collar, and accompanying increases in friction. Conventional devices, having detents impacted by the main spring, were tested and it was determined that when the detents of the conventional devices were removed, a larger clamping force was achievable given the same amount of user input force. The mount assembly of the present disclosure eliminates this problem because the detent springs of the present disclosure are significantly weaker, thereby requiring a significant less amount of force overcome the detent. Once the mount assembly 16 is attached, the lobes 52, 64 and sloping surfaces 63, 62 of the detent ring 32 and front collar 34 resist rotation of the front collar in a direction that would loosen its attachment to the flash hider 18.

Finally, the force required to dislodge the detents 44 of the rear collar 34 from the recesses 58 of the detent ring 32 does not substantially change during coupling. For example, the force/torque required to move the detent out of a first of the recess 58 is the same as that required to move the same detent out of the $20^{th}$ recess. From a user standpoint, as the user tightens the mount assembly 16 onto the flash hider 18 it becomes easier to the tighten the front collar 22 onto the rear collar 34 and against the flash hider 18 as the mount assembly is turned after overcoming the initial preload.

Figure 14:
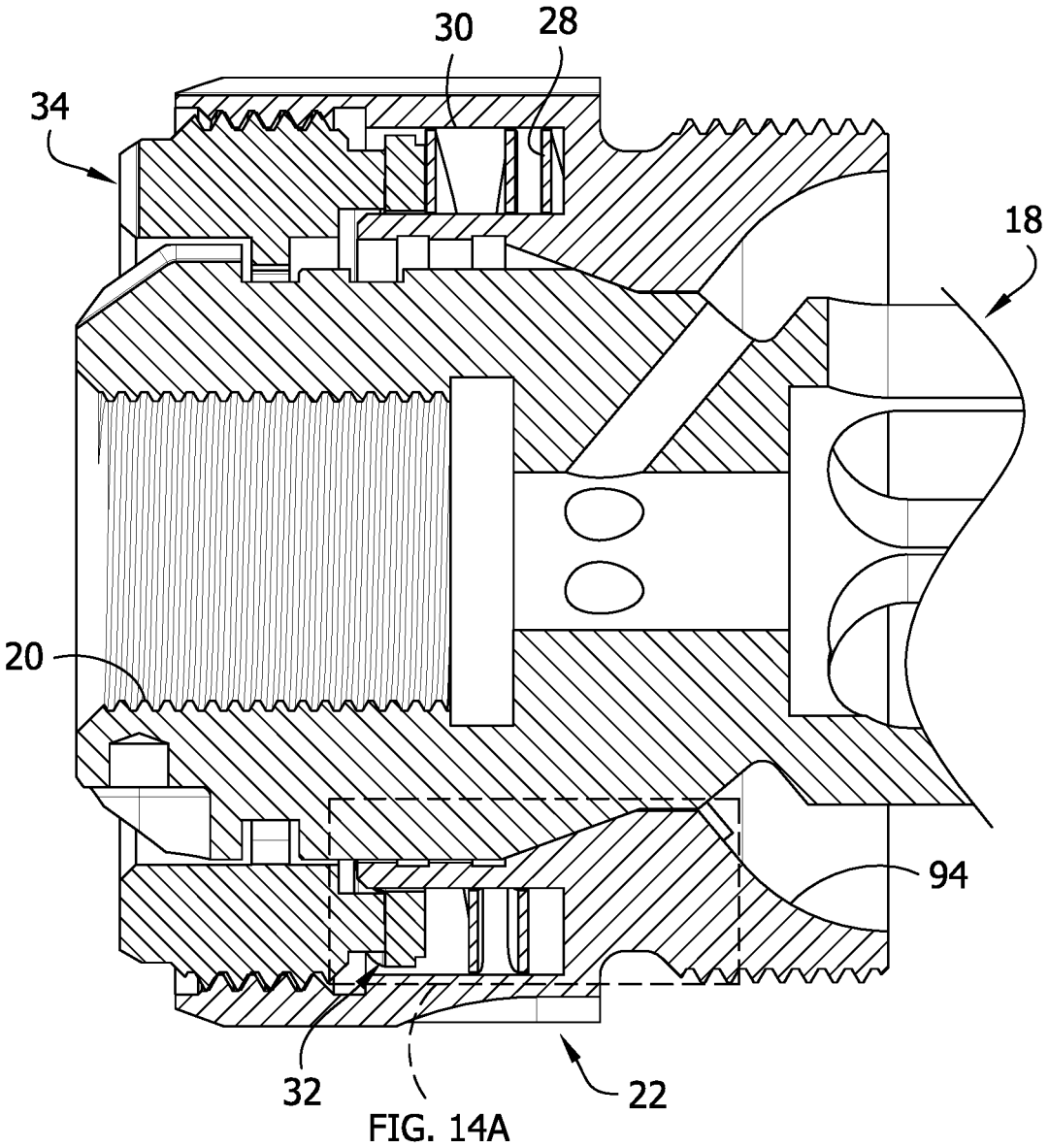
FIG. 14 is a fragment of the longitudinal section of FIG. 10.
Figure 14A:
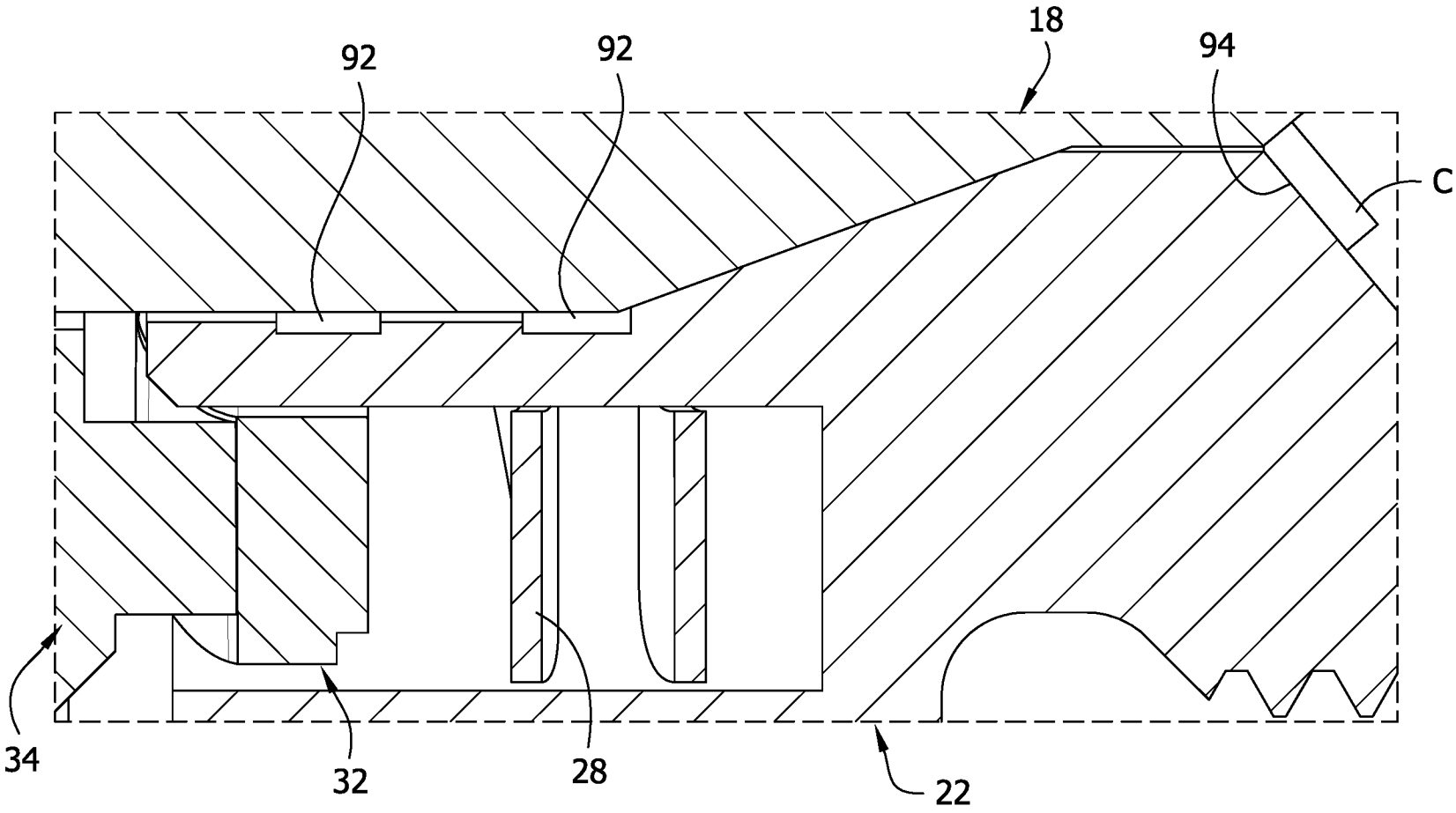
FIG. 14A is a fragment of the longitudinal section of FIG. 14 showing anti-carbon lock features.

Referring now to FIGS. 14 and 14A, the mount assembly 16 of the present disclosure is also configured to reduce carbon lock. For example, the mount assembly 16 can be used to attach a suppressor (not shown) to a firearm. Suppressors trap significant amount of gas that is expelled from the firearm during the firing event. Constituents of the gas are deposited on exposed surfaces and begin to accumulate. Once the deposits accumulate to the point that the attachment method cannot be removed, it is said to be carbon locked. This can occur very quickly on some attachment structures and prolonging or preventing the occurrence of carbon lock is a critical performance metric of the attachment structure and method.

The geometry of the mount assembly 16 is arranged to provide the utmost resistance to allowing expelled gasses entering the mating surface area (defined as anything to the rear, left in view, of the leading taper). The leading taper (e.g., tapered seat 88 of the front collar 22) is the first defense as a good, complete seal will block a significant amount of gas entering the mating area. Any gasses that do get past this seal will accumulate in every area possible. To this end, the mount assembly 16, specifically the interior surfaces of the front collar 22, includes one or more grooves 92 at the mating surface area. By providing one or more grooves at the mating surfaces, the soot and other debris from firing will accumulate in the grooves 92. This delays the point at which the soot and other debris will interfere with the operation of the mount assembly 16 as it will take longer to fill the grooves than if they were not there. The threaded connection between the front collar 22 and the rear collar 34 is protected by the presence of the grooves from being fouled quickly by exhaust gases from firing events.

The front collar 22 is also arranged such that the carbon buildup will not interfere with the removal of the front collar (broadly, the mount assembly 16) from the flash hider 18. Specifically, the front collar 22 has collection ("diverging") surface 94 in front of the mating surfaces that extends at a generally perpendicular angle from an exterior surface of the flash hider 18. As a result of the orientation of the collection surface 94 relative to the flash hider 18, the carbon buildup C (shown in FIG. 14A) on the collection surface does not interfere with the removal of the mount assembly from the flash hider. The front collar 22 may move to the right (as oriented in FIG. 14) without the carbon built up C on the collection surface 94 interfering with this movement.

It will be apparent that modifications and variations are possible without departing from the scope of the invention defined in the appended claims. Alternative constructions and embodiments referenced herein are within the scope of the present invention.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A mount assembly for attaching a firearm accessory to a muzzle of a firearm, the mount assembly comprising:

a rear collar configured to connect to the muzzle;

a front collar coupled to the rear collar for movement relative to the rear collar, the front collar and rear collar being constructed and arranged relative to each other to capture a portion of the muzzle between them to attach the mount assembly to the muzzle;

a detent ring movable relative to the rear collar; and a spring disposed between the detent ring and the front collar and generating a spring force biasing the detent ring toward the rear collar;

wherein the rear collar, the front collar, and the detent ring are shaped so that an amount of the spring force biasing the detent ring toward the rear collar decreases during at least a portion of a time the distance between the front collar and the rear collar decreases while attaching the mount assembly to the muzzle.

2. The mount assembly of claim 1, wherein one end of the spring is engaged with a forward-facing surface of the detent ring and an opposite end of the spring is engaged with a rearward-facing surface of the front collar, a distance between the forward-facing and rearward facing surfaces increasing during said portion of the time the front collar moves toward the rear collar to attach the mount assembly to the muzzle.

3. The mount assembly of claim 1, wherein the rear collar has a first cam interface and the detent ring has a second cam interface engaged with the first cam interface of the rear collar.

4. The mount assembly of claim 3 wherein the first and second cam interfaces of the rear collar and detent ring are contoured so that upon relative rotation in the same direction of the rear collar and detent ring, the first and second cam interfaces move away from each other and toward each other.

5. The mount assembly of claim 4 wherein the detent ring has different thicknesses at locations around the circumference of the detent ring.

6. The mount assembly of claim 4 wherein the second cam interface of the detent ring comprises a lobe, a first sloping surface extending from one side of the lobe in one circumferential direction and a second sloping surface extending from an opposite side of the lobe in an opposite circumferential direction, a slope of the first sloping surface being less than a slope of the second sloping surface.

7. The mount assembly of claim 6 wherein the first cam interface of the rear collar comprises a lobe, a first sloping surface extending from one side of the lobe in one circumferential direction and a second sloping surface extending from an opposite side of the lobe in an opposite circumferential direction, a slope of the first sloping surface being less than a slope of the second sloping surface.

8. The mount assembly of claim 7 wherein the lobe of the detent ring constitutes a first lobe, the detent ring further comprising a second lobe having a first sloping surface extending from one side of the lobe in one circumferential direction and a second sloping surface extending from an opposite side of the lobe in an opposite circumferential direction, a slope of the first sloping surface being less than the slope of the second circumferential surface, the first sloping surface of the first lobe intersecting the second sloping surface of the second lobe, and the first sloping surface of the second lobe intersecting the second sloping surface of the first lobe.

9. The mount assembly of claim 8 wherein the intersections of the first sloping surface of the first lobe with the second sloping surface of the second lobe, and of the first sloping surface of the second lobe with the second sloping surface of the first lobe are located at a minimum thickness of the detent ring.

10. The mount assembly of claim 6 wherein the cam interface of the rear collar comprises a lobe, a first sloping surface extending from one side of the lobe in one circumferential direction and a second sloping surface extending from an opposite side of the lobe in an opposite circumferential direction, a slope of the first sloping surface being less than a slope of the second circumferential surface.

11. The mount assembly as set forth in claim 1 wherein at least one of the front collar and the rear collar is formed with an alignment indicator positioned to align the mount assembly for placement onto the muzzle of the firearm.

12. The mount assembly as set forth in claim 1 further comprising a detent assembly interengaging the detent ring and the rear collar.

13. The mount assembly as set forth in claim 12 wherein the detent assembly comprises a detent and a detent spring engaging the detent and biasing the detent against the detent ring, the detent spring having a spring force that is less than the spring force the spring.

14. A mount assembly as set forth in claim 1 wherein the front collar has a tapered interior surface mounted for movement with respect to the rear collar and positioned for clamping a portion of the flash hider between the front collar and the rear collar, the tapered interior surface being sized and shaped for flush engagement with a taper of the flash hider to inhibit the ingress of debris between the front collar and the flash hider.

15. The mount assembly as set forth in claim 14 wherein the front collar includes a diverging surface adjacent to the tapered interior surface, the diverging surface extending away from the flash hider when the mount assembly is attached to the flash hider, the diverging surface intersecting the flash hider at an angle.

16. The mount assembly as set forth in claim 15 wherein the diverging surface of the front collar intersects the flash hider is at an angle generally perpendicular to the flash hider when the mount assembly is attached to the flash hider.

17. The mount assembly as set forth in claim 14 wherein the front collar has one or more grooves disposed rearward of the tapered interior surface of the front collar and arranged to receive debris that ingresses between the front collar and the flash hider.

18. A mount assembly for attaching a firearm accessory to a muzzle of a firearm, the mount assembly comprising:

a rear collar configured to connect to the muzzle;

a front collar coupled to the rear collar for movement relative to the rear collar, the front collar and rear collar being constructed and arranged relative to each other to capture a portion of the muzzle between them to attach the mount assembly to the muzzle;

a detent ring movable relative to the rear collar; and a main spring disposed between the detent ring and the front collar and generating a spring force biasing the detent ring toward the rear collar;

a detent assembly comprising a detent supported by one of the rear collar and the detent ring, and a detent spring engaging the detent and biasing the detent against the detent ring, the main spring having a spring force greater than a spring force of the detent spring.

19. The mount assembly as set forth in claim 18 wherein the detent constitutes a first detent and the detent spring constitutes a first detent spring, the detent assembly further comprising a second detent and second detent spring, the main spring having a spring force greater than the sum of spring forces of the first detent spring and the second detent spring.

20. The mount assembly as set forth in claim 19 wherein the first and second detents and first and second detent springs are mounted on the rear collar, and wherein the detent assembly further comprises recesses in the detent ring spaced apart from each other along a circumference of the detent ring, each recess being sized and shaped to receive one of the first and second detents for yieldably locking the rear collar and the detent ring against relative rotation.

* * * * *